US011692797B2

(12) United States Patent
Kim et al.

(10) Patent No.: US 11,692,797 B2
(45) Date of Patent: Jul. 4, 2023

(54) PERMANENT MAGNET SEED FIELD SYSTEM FOR FLUX COMPRESSION GENERATOR

(71) Applicant: Enig Associates, Inc., Rockville, MD (US)

(72) Inventors: Yil-Bong Kim, Silver Spring, MD (US); Eric N. Enig, Bethesda, MD (US)

(73) Assignee: ENIG ASSOCIATES, INC., Rockville, MD (US)

( * ) Notice: Subject to any disclaimer, the term of this patent is extended or adjusted under 35 U.S.C. 154(b) by 109 days.

(21) Appl. No.: 17/603,996

(22) PCT Filed: Apr. 15, 2020

(86) PCT No.: PCT/US2020/028357
§ 371 (c)(1),
(2) Date: Oct. 15, 2021

(87) PCT Pub. No.: WO2021/006938
PCT Pub. Date: Jan. 14, 2021

(65) Prior Publication Data

US 2022/0214147 A1 Jul. 7, 2022

Related U.S. Application Data

(60) Provisional application No. 62/833,872, filed on Apr. 15, 2019.

(51) Int. Cl.

| | |
|---|---|
| ***F42B 1/028*** | (2006.01) |
| ***F42B 6/00*** | (2006.01) |
| *F41B 6/00* | (2006.01) |

(52) U.S. Cl.
CPC ..... *F42B 1/028* (2013.01); *F42B 6/006* (2013.01); *F41B 6/006* (2013.01)

(58) Field of Classification Search
CPC ..... F42B 1/028; F42B 6/006; F41B 6/006
USPC ..... 124/3
See application file for complete search history.

(56) References Cited

U.S. PATENT DOCUMENTS 4,370,576 A 1/1983 Foster, Jr. et al.
9,658,026 B1 * 5/2017 Grace ..... F41B 6/006
(Continued)

FOREIGN PATENT DOCUMENTS

RU 2260896 C1 9/2005

OTHER PUBLICATIONS

CM Fowler, LL Altgilbers; Los Alamos National Laboratory; US Army Space and Missile Defense Command; "Magnetic Flux Compression Generators: a Tutorial and Survey" (Year: 2003).*
(Continued)

*Primary Examiner* — Samir Abdosh
(74) *Attorney, Agent, or Firm* — Browdy and Neimark, P.L.L.C.

(57) ABSTRACT

An explosive device composed of an auxiliary flux compression generator operating to produce a high intensity magnetic field to seed a primary flux compression generator The auxiliary flux compression generator has a first section with a magnetic field supplied by a cylindrical permanent magnet array, the first section is composed of a helical winding having a prescribed pattern configured to convert explosive energy into magnetic energy that will be used as seed magnetic field for the primary flux compression generator.

6 Claims, 8 Drawing Sheets

(56) References Cited

U.S. PATENT DOCUMENTS

| | | | | |
|---|---|---|---|---|
| 2014/0227548 | A1* | 8/2014 | Myrick | C10L 1/28 203/40 |
| 2016/0258730 | A1* | 9/2016 | Bonbrake | F42C 11/04 |
| 2017/0191814 | A1 | 7/2017 | Grace et al. | |
| 2018/0251237 | A1* | 9/2018 | Palmer | B64G 5/00 |

OTHER PUBLICATIONS

Fowler, C et al. "Magnetic Flux Compression Generators: a Tutorial and Survey" Electromagnetic Phenomena, V.3, 3 (11),2003 (Jan. 25, 2021), <http://citeseerx.ist.psu.edu/viewdoc/download?doi=10.1.1.891.3200&rep=rep1&type=pdf>.

Liu, Pet al. "Development of compact explosively driven ferromagnetic seed source for helical magnetic flux compression generator"; AIP Advances 8, 056805, 2018 (Jan. 25, 2021). <https://aip.scitation .org/doi/pdf/10.1063/1.5006340&9!>.

Reinovsky, R et al. "An Economical, 2 Stage Flux Compression Generator System"; Research Report Document, Jun. 1985 (Jan. 22, 2021), <https://apps.dtic.mil/sti/pdfs/ADA638809.pdf>.

Goforth, J.H. et al., "The Ranchero Explosive Pulsed Power System," 11th IEEE International Pulsed Power Conference, Hyatt Regency, Baltimore MD, (Jun. 29-Jul. 2, 1997).

Neuber, A. et al., "Compact High Power Microwave Generation," Proceedings of the Army Science Conference (26th), Orlando, Florida, (Dec. 1-4, 2008).

Wheeler, Harold A., "Inductance Formulas for Circular and Square Coils," Proceedings of the IEEE, vol. 70, No. 12, p. 1449-1450, Dec. 1982.

* cited by examiner

Single Layer Wound $$L = \frac{(rN)^2}{9r + 101}$$

PERMANENT MAGNET SEED FIELD SYSTEM FOR FLUX COMPRESSION GENERATOR

BACKGROUND OF THE INVENTION

The field of the present invention relates to projectiles containing a flux compression generator (FCG) for producing a high current that acts to produce a metal mass and project that mass as a jet to penetrate a target.

Flux compression generators are already known in the art. Examples thereof are disclosed in U.S. Pat. No. 4,370,576, Foster, Jr., issued on Jan. 25, 1983, and U.S. Pat. No. 9,658,026, Enig et al, and the entirety of which are incorporated herein by reference.

It is known that extremely high magnetic fields can be obtained using high explosives as an energy source in devices known as flux compression generators. In such a generator, an explosive detonation compresses an established low-level magnetic field into a very high density field, with an associated high electrical current flow. Typically, a low-level magnetic field is established within a confined space or cavity and acted upon by the force of explosive detonation to collapse that space to a relatively small volume in which the magnetic field is trapped and compressed. Since the trapped magnetic field exerts magnetic pressure, the explosive does work against that pressure and in the process transfers its chemical energy into electrical energy within the FCG electrical circuit to include the energy stored within the compressed magnetic field. The FCG principles apply to various geometries where the size of the space, or cavity, is reduced. To date, mostly cylindrical geometries have been explored.

There are two types of cylindrical FCGs, namely, coaxial and helical.

A coaxial generator consists of a central cavity containing a centrally located cylindrical shell, filled with a high explosive and acting as a conducting armature, a cavity between the armature and an outer metallic shell that acts as a conducting stator, and conducting end caps to complete the electrical circuit and provide confinement of the compressed magnetic field. One example of a coaxial generator that can be employed in devices according to the invention is disclosed in: J. H. Goforth, et al, "The Ranchero Explosive Pulsed Power System," $11^{th}$ IEEE International Pulsed Power Conference, Hyatt Regency, Baltimore Md., Jun. 29-Jul. 2, 1997.

A helical generator consists of a similar armature, a stator formed from windings of wires, a cavity between the armature and stator, and end caps. Generally, an electrical load, in the form of a relatively small cavity encased in conducting metals, is attached to the output end of the FCG. One example of a helical generator that can be employed in devices according to the invention is disclosed in: A. Neuber, A. Young, M. Elsayed, J. Dickens, M. Giesselmann, M. Kristiansen, "Compact High Power Microwave Generation," *Proceedings of the Army Science Conference* (26th), Orlando, Fla., 1-4 Dec. 2008.

In addition, an internal arrangement within the device is structured so that an electrical "seed" current can be fed to the metal wire conductors forming the circuit of the stator, armature, end caps, and electrical load that define the cavities of the FCG and the load. The flow of current in the conductors around these cavities establishes a "seed" magnetic field within the cavities. The cavities represent inductances while the conductors have electrical resistance. In operation, upon detonation, the armature expands radially and collides with the stator. During that process, flux compression takes place because the FCG cavity width is reduced to nearly zero. To a first order, the FCG output current results from the starting inductances of both cavities relative to the final inductance of the system after magnetic compression. When the FCG is completely collapsed, current gain is the ratio of the initial cavity inductance to the final inductance represented by the load.

An advantage of the helical generator with its wire wound stator is that a much higher initial inductance can be obtained per unit length, but at the expense of added complexity. In contrast, the coaxial generator has a simpler construction, but with a considerably lower initial inductance. Both generators can have electrical breakdown (arcing) since the current and voltages rise during compression unless care is taken to use insulating gas in the cavities. The helical generator can also break down if the voltage between wires rises above a threshold limit related to the insulation used between windings. Further, because of Joule heating due to resistance, the wires can only carry a limited amount of current without reaching their melting temperature. For well-designed generators of similar length, typical current gains are 10 to 12 for the coaxial types, and above 2000 for a helical wound generator. Often, coaxial generators are used with much higher seed current to get high output current since premature electrical breakdown and wire melting are not issues.

When initiation of the high explosive (HE) is started at one end of the HE column, i.e. along the length of the generator, the detonation wave travels from that end to the opposite end of the column, referred to as the output end. Armature radial motion first occurs at the initiation end with a progressive expansion from the initiation end to the output end. This sequential motion results in an armature expansion that has a conical profile with the cone becoming progressively larger until successive elements strike the stator. Thus, the armature first strikes the stator at the initiation end and subsequently strikes the stator at progressive locations until impact with the entire stator is complete at the output end. As the armature progressively fills the cavity, magnetic compression progressively takes place. The progression gives rise to a near exponential increase in current to a peak value that occurs near to total cavity collapse where the system inductance has a minimum value. Thus, for the helical generator, initial winding sections are subject to relatively low voltages and temperatures while sections toward the output end approach or exceed the voltage and temperature limits. Internal voltages, electrical breakdown, and wire melting have limited the ability to develop more efficient flux compression generators. In addition, explosive initiation techniques and quality control of fabricated parts including the end caps, stators, and armatures have a major influence on the ability to improve current outputs of FCGs.

An FCG can act as a global source of energy that can be focused to power multiple liners to include dual liners where electrical energy is applied through electrical conduits connecting the FCG with the electrical loads. Timing for the action of each liner can be accomplished through dynamic electrical switching. When a follow-through munition is employed, the FCG can be designed as an annular coaxial structure that encloses the munition at its center. Since no explosives surround liner loads, and the munition resides within the FCG, a highly compact and efficient multiple mode warhead can be constructed. A single detonator activates the FCG, which in turn powers the liners without further HE initiation. The present invention constitutes a higher efficiency FCG than previous designs by combining in "unitary" fashion an initial helical section where currents are relatively low with a final coaxial section where current is high. Also, the present invention utilizes several helical winding sections along its length, each with varied pitch and wire size to accommodate increased currents as the armature engages successive stator sections. At the ends of each helical winding section, wires are bifurcated to allow each section to progressively cope with increasing current by splitting that current between multiple wires. This approach provides a highly efficient FCG design with increased output current to project higher levels of lethal kinetic energy.

The output of the FCG can be connected to selected loads through thin insulated channels. Upon command, the selected load is connected to the FCG by dynamic switching. Using a FCG power source, sufficient thermal energy is available through Joule heating to ignite RM's (reactive materials) at multiple and closely spaced sites to obtain rapid and abrupt near volume combustion.

Any and all of the aforementioned techniques can be combined into a single warhead configuration to produce multi-modal kinetic energy/blast effects. The technology is scalable and thus can be applied to various systems to include small hand placed devices to large missiles and projectiles. In total, therefore, the invention has advantages in terms of utility, costs, and performance over prior art or conventional approaches.

A projectile or missile of the type described includes the following components: 1) a central munition; 2) a wrap-around FCG, i.e. an FCG composed of annular components that enclose the central munition: 3) dual liners as the electrical load; 4) a buffering system; 5) a generator explosive; 6) an initiation scheme to ring initiate the FCG explosive, and 7) an electronics package for producing a seed current for the FCG. The dual liner includes: a shaped charge; a shaped charge end cap; a shaped charge stator; a circular switch; an MFP (Magnetically formed projectile) stator; and an MFP.

The basic components of a known explosive device for launching kinetic energy are shown in FIGS. 1 and 3. The device includes a flux compression generator, electrical loads composed of two shaped charge liners, a central munition, a means to detonate the high explosives, and an electronic unit to produce starting current for the generator.

As shown, the FCG portion of the system has an armature 1, an annular shell of high explosives (HE) 2 enclosed by armature 1, a helical wound stator 3 surrounding armature 1, a stator 4 aligned with, and electrically connected to, stator 3, and a cavity 5. A buffer 6 separates high explosives 2 from the centrally located munition having a metallic casing 7 that is filled with explosive 8 having its own detonator 8*a*. The generator output end, to the right in FIG. 1, contains an armature glide rail 9 and an insulated channel 10. The initiation end that is opposite to the output end utilizes glide rail 11 together with a gap 12 that will act as a switch, known as a crowbar switch. Ignition of the high explosives 2 is initiated by a "ring" circular initiator 13 that is in turn ignited by ignition of a detonator 14.

Attached to the FCG output end is an electrical load that in this case contains a dual liner arrangement 15, 19.

A shaped charge liner 15 is a conical shell disposed coaxially with respect to a longitudinal axis of the device, enclosed by a liner stator 16 with a so-called "glide" plane, or glide surface, 17 in conductive contact with the large diameter end, or base, of liner 15, and with a glide plane 18 making conductive contact with the small diameter end, or apex, of liner 15. The glide planes guide the armature ends along their respective surfaces to maintain contact to keep the circuit intact as the armature moves outward. Liner 15 can have various cross-sectional shapes, such as conic sections, tulip, trumpet, or be freely varied depending on the formed penetrator structure desired.

Positioned beyond the liner base end is the MFP section of the dual liner load. MFP liner 19 is coaxial with, and may or may not have the same diameter as, an MFP stator 20 and MFP base glide plane 21. Glide plane 17 also serves as the apex glide plane for the MFP liner 19. MFP liner 19 and glide plane 17 enclose a circular hole, or opening, that is concentric to the device central axis. The end of the MFP base glide plane 21 encloses a relatively large diameter hole, or opening, that communicates with exterior space outside the device. Insulated channel 10 extends beyond glide rail 9 and continues between liner 15 and liner stator 16, between base liner glide plane 17 and MFP stator 20, and between MFP stator 20 and MFP liner 19. A circular switch 22 placed along insulated channel 10 at a position between shaped charge section 15 and the MFP section 19 controls the amount of FCG output current being applied to MFP liner 19 relative to that applied to liner 15. MFP liner 19 may have various cross-sectional shapes, such as described above with respect to liner 15.

All of the illustrated components have a circular and annular form and are coaxial with a longitudinal axis of the device.

Exemplary materials for the above described components may include conducting metals such as copper or aluminum for armature 1, wires for stator 3, coaxial section 4, liner stator 16, glide surface 17, apex glide surface 18, MFP stator 20, and MFP glide surface 21. Liner 15 and MFP liner 19 are composed of aluminum, copper, molybdenum, tantalum, for example. Typically, munition casing 7 is made of steel while munition HE 8 is composed of TNT, PBX, TATB, or TATB derivatives. Buffer 6 is a layer of polyethylene or low density shock-absorbing material.

An electronic section 32 is joined to the FCG at the initiation end and contains a battery 23, capacitor 24, a positive electrical connection 25 with a series switch 35 and a negative electrical connection 26 to supply current from battery 23 to capacitor 24. Battery 23 may be a thermal battery, in which case series switch 35 can be omitted. In operation, series switch 35 will be closed or the thermal battery will be activated in response to activation of a point contact fuse or a proximity fuse associated with the device. The electrical circuit from capacitor 24 uses a switch 36 to connect to the FCG. The closing of switch 36 is controlled by suitable electronic circuitry that responds to the charging of capacitor 24 and closes switch 36 when the voltage across capacitor 24 reaches a selected level. When the switch 36 is "on", or closed, capacitor 24 is connected to the helical stator 3 with stator wire 27 and to armature 1 through armature wire 28. An exterior electrical signal activates battery 23 that in turn charges capacitor 24. Circuit switch 36 to the FCG is turned on after capacitor 24 has been fully charged.

In FCG operation, closure of a switch in a standard point contact or proximity fuse on the projectile or missile activates thermal battery 23 and closes switch 35 to in turn charge capacitor 24 in sub-milliseconds. At the end of the charging period, circuit 36 switch connects capacitor 24 with helical stator 3 through wire 27 and armature 1 through wire 28. Flow of current out of capacitor 24 passes, in sequence, through the conducting metals of helical stator 3, coaxial stator 4, liner stator 16, switch 22, MFP stator 20, MFP base glide plane 21, MFP liner 19, liner base glide plane 17, liner 15, liner apex glide plane 18, armature 1, and returns to capacitor 24 through wire 28. Thus, current flows around cavity 5 and insulated channel 10 throughout the FCG/load system. The current flow establishes a "seed" current in the conductors and a seed magnetic field within cavity 5 and insulated channel 10.

After the seed current and magnetic field are established, detonator 14 is activated. This activation is produced by conventional circuitry in electronic section 32 at a selected time after closure of switch 36 and establishment of the seed current. Detonator 14 ignites, or detonates, circular initiator 13, which, in turn, effects an annular detonation of FCG high explosives 2. The annular initiation of explosives 2 creates a detonation wave that travels from the initiation end, adjacent initiator 13, to the output end, adjacent stator 16 and glide plane 18, of the FCG. Pressure resulting from the detonation of explosives 2 accelerates armature 1 at the initiation end firstly to a given outward radial velocity that depends on the masses of armature 1 and high explosives 2, and the specific energy of the type of FCG explosives 2 used. After the initial movement by armature 1 at the initiation end, armature 1 closes gap 12, and strikes glide rail 11. This action shorts out the capacitor 24 from the main FCG circuit that is now comprised of the metallic conductors described previously, but excludes capacitor 24 and thermal battery 23. As the detonation wave sweeps across explosives 2 from initiation end to FCG output end, armature 1 takes on a conical shape and enters cavity 5. Thus, armature 1 engages stator 3 first at the initiation end and progressively contacts additional windings of stator 3 sequentially. Windings of stator 3, after contact by armature 1, are eliminated from the active FCG electrical circuit. The volume of cavity 5 is reduced as armature 1, during its continued, axial progressive outward motion, continues to contact helical stator 3 and subsequently coaxial stator 4 until armature 1 reaches the opening between output end glide rail 9 and coaxial stator 4 delimited, or defined, by insulated channel 10. At that point, the volume, and therefore the inductance, of cavity 5 have been reduced to near zero and FCG function is complete.

In operation, the trapped magnetic field intensity and magnetic pressure acting against inside surfaces of the metallic conductors grow exponentially as armature 1 invades cavity 5. Thus, motion of armature 1 causes a progressively stronger magnetic pressure to act against armature 1. In this manner, displacement of armature 1, driven by the detonation of explosives 2, constitutes work done by explosives 2 in creating a greater magnetic field intensity and electrical current in the circuit. Essentially, chemical energy released by explosives 3 during detonation is converted to electrical energy in the form of a high current and magnetic field intensity.

At the end of FCG function, within the electrical loads consisting of liner 15 and MFP liner 19, an intense magnetic field having field lines in the circumferential direction exists everywhere within channel 10 together with an intense current flow traveling axially along conducting surfaces. Thus, Lorentz forces described by JXB (where J is the current vector, B is the magnetic field vector, and X is the vector cross product operator) are developed in the conductors that cover channel 10. The forces can be seen as a magnetic pressure that accelerates metallic conductors in a direction normal to their surfaces. Generally, liner stator 16 and MFP stator 20 are massive compared to liner 15 and MFP liner 19 so that little kinetic energy is acquired by liner stator 16 and MFP stator 20 during acceleration of liner 15 and MFP liner 19. Liner 15 is imploded by action of magnetic pressure and coalesces violently on the longitudinal axis of the device to form a jet according to jet formation principles. MFP liner 19 can be accelerated forward to form a "washer-like" ring or compact rod on axis depending on its starting inclination. Since liner 15 is inclined at a large angle, it arrives on axis first and forms a jet that travels unobstructed through the hole in MFP liner 19 and liner base glide plan 17. Subsequently, MFP liner 19 forms a compact rod on axis after the entire jet has passed beyond the collapsing MFP liner 19.

To assure that liner 15 is sufficiently accelerated prior to MFP liner 19, switch 22 temporarily prevents current flow about the portion of channel 10 that extends between MFP liner 19 and stator 20. Switch 22 has a small mass and is initially closed but acts as an opening switch in response to magnetic pressure.

FIG. 2 illustrates a point in time after explosives 2 have detonated and the shaped projectiles 29, 30 and 31 have been formed. The previous positions of liners 15 and 19 are shown in broken lines. At this time, detonation of high explosives 2 is complete while the central munition composed of munition casing 7 and HE 8 remain intact due to the provision of buffer 6. Meanwhile, the FCG has delivered kinetic energy to armature 1, and armature 1 has expanded and invaded cavity 5, reducing the volume, and therefore the inductance, of cavity 5 to a minimum. Liner 15 is accelerated, has coalesced at the longitudinal axis of the device, formed jet 29, and passed through the central hole within MFP liner 19. During this jet formation process, liner 15 separates into fast moving jet 29 and slowly moving slug 30. MFP liner 19 also is accelerated to form a rod-like penetrator 31 on the device longitudinal axis. The jet penetrator 29 travels, for example, at a speed of the order of 10 km/s, whereas MFP rod 31 may have a velocity of roughly 2 to 3 km/s and slug 30 may have velocity of 1 km/s. Thus, MFP rod 31 travels faster than slug 30 but slower than jet 29, placing MFP rod 31 between jet 29 and slug 30. Jet 29 and MFP rod 31 act together to impact a target. With proper relative thicknesses and inclinations of liner 15 and MFP liner 19, switch 22 may not be required to obtain an axial arrangement of jet 29, followed by MFP rod 31, followed by slug 30, as previously described.

HE 8 will be detonated upon impact of the device on a target, by activation of detonator 8*a* by a suitable, conventional impact responsive device.

The FCG and electrical loads can be separated by a horizontal extension of channel 10 and surrounding cylindrical shell conductors, allowing space between the two components to accommodate a payload or munition. The FCG electrical energy may be transmitted through an electrical transmission cable so that the load and FCG can be fired remotely and far away from the vicinity of the electrical load.

FCG function as described applies equally well to generators that do not contain a central munition, and do not constitute a "wrapped-around" configuration, but have a solid cylindrical explosive core within the armature. FCG output energy or current depends upon changes in inductances of the FCG and loads, and the level of seed current used to start FCG operation. Thus, FCG devices allow for varied electrical output ranging from the maximum based on FCG design to zero when zero seed current is applied. Control of FCG output energy provides a benefit in application to devices that can be conditionally altered for maximum effects or limited effects to address situations where non-lethal or limited collateral damage are required.

FIG. 3 shows an example of the FCG/load electrical circuit, which includes an electronic section 32, an FCG section 33, and electrical load section 34. Electronic section 32 contains thermal battery 23, capacitor 24, capacitor charging switch 35, and capacitor discharge switch 36. Components in electronic section 32 are connected to FCG variable resistor 37 representing the metallic conductor resistance within the FCG, variable resistor 40 representing the metallic conductor resistance associated with the electrical load section that contains liner 19, variable inductor 38 representing the inductance of cavity 5, and variable inductor 39 representing the inductance associated with the cavity between liner 15 and its stator 16.

Crowbar switch 12 is open initially as current is established in the circuit. Output of the FCG is connected to shaped charge liner 15, represented electrically by a variable inductor 39 and a liner variable resistor 40. Initially, circular switch 22 blocks current to MFP liner 19, represented electrically by a variable resistor 41 and an MFP liner variable inductor 42.

The resistances are associated with the flow of current through metallic conductors and are usually kept small using metals like copper or aluminum, for example. Minimum system resistance allows more efficient energy output from the FCG.

After the entire circuit is activated by discharge of capacitor 24 with closure of switch 36 to establish seed current and seed magnetic field, a firing signal is sent to detonator 14. Consequently, initial motion of the armature closes switch 12, which cuts the circuit in electronic section 32 out of the FCG and load circuit. As the inductance of FCG variable inductor 38 decreases with further armature motion, current increases in the circuit. The increase in current accelerates shaped charge liner 15, thereby creating a progressively increasing cavity between liner 15 and stator 16 and therefore the inductance of liner load inductor 39 increases. The FCG output current reaches a very high level when FCG cavity collapse is complete, but while a high level of liner acceleration results from the high current, time is required to develop appreciable liner displacement and associated increase in inductance of liner inductor 39. Thus, the system inductance of combined liner inductor 39 and FCG inductor 38 reaches a minimum near the time of maximum current. By design, current is supplied first to shaped charge liner variable inductor 39 so that the jet can be formed without interference by MFP formation. Subsequently, circular switch 22 opens to allow current flow through resistors and inductors of both loads.

It has already been established that extremely high magnetic fields (hundreds of Teslas (T)) and high currents (tens of mega amperes) can be obtained using high explosives as an electromagnetic energy source in devices known as flux compression generators (FCG). An FCG is a compact device that compresses and amplifies magnetic field intensity to produce many mega amperes of electrical current using a magnetic flux compression energy conversion mechanism. During magnetic flux compression, chemical energy of a high explosive (HE) is converted to electromagnetic (EM) energy to generate high currents that can be applied to various electrical loads. Maximum energy conversion efficiency of HE energy to electromagnetic energy can be as high as 30%, while the remaining energy is stored as internal thermal energy within the HE gaseous products (40-50%) or appears as FCG electrical Joule heating loss (10-20%). For a particular FCG device, the final magnitude of the electrical output current depends upon the level of seed current supplied in a monotonically increasing manner. This seed current (and the associated seed magnetic field) is typically supplied by large, high voltage capacitor banks that will require certain timing circuits to initiate charging from the high voltage power supply and discharging to the FCG right before FCG operation. These procedures would require several timing sequences that range from sub milliseconds to seconds.

For many DOD and practical FCG applications, this extra seed current operating time will cause a delay in the FCG operation by a few seconds or so. In this scenario, the FCG is used as a very high current generator to the load of interest (e.g., offensive kinetic energy shaped charge jets, flier plates, magnetically formed penetrators, auxiliary hypervelocity projectile accelerators, etc.; or defensive EM armor plates and EM energy extractors). In all these practical scenarios, the extra time (i.e., seconds) introduced by the seed current system prohibits the use of the FCG as an almost instantaneous high EM power generator. For example, if an FCG is used as a high current generator for an EM armor application to defeat an incoming shaped charge jet threat, it is necessary to activate the FCG within threat detection and operation time scales on a microsecond time scale rather than the long delay introduced by seed current capacitor bank systems. Moreover, the typical required seed bank system to generate a few kAs of seed current to an FCG can be very bulky, making the whole self-contained FCG system impractical.

SUMMARY OF THE INVENTION

It is an object of the present invention to provide novel FCG devices that can replace bulky and slow seed current capacitor bank systems with a very compact seed current system using permanent magnets, such as neodymium magnets.

DETAILED DESCRIPTION OF THE INVENTION

Figure 1:
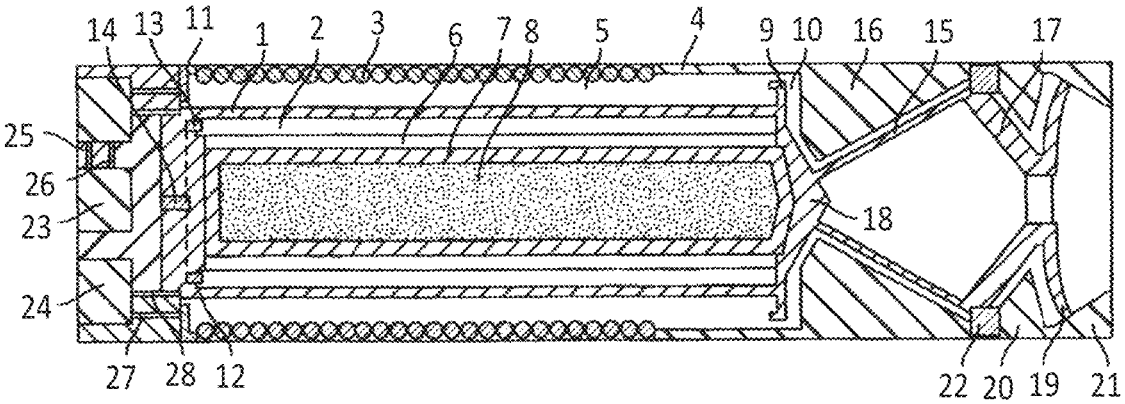
FIG. 1 PRIOR ART
FIG. 1 is a cross-sectional view of a prior art FCG device constructed to be housed in a suitable projectile, or missile.
Figure 2:
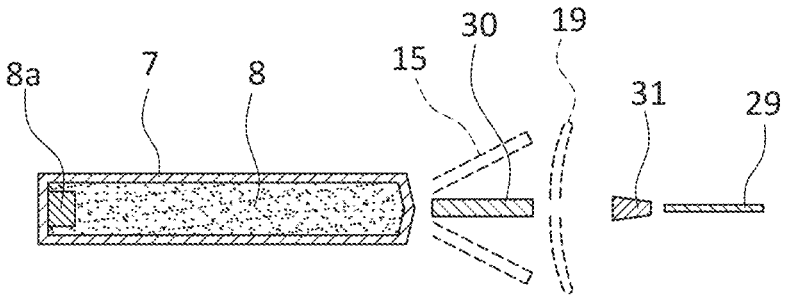
FIG. 2 PRIOR ART
FIG. 2 is a cross-sectional view of the device of FIG. 1, which illustrates FCG action and resulting formed MFP and jet.
Figure 3:
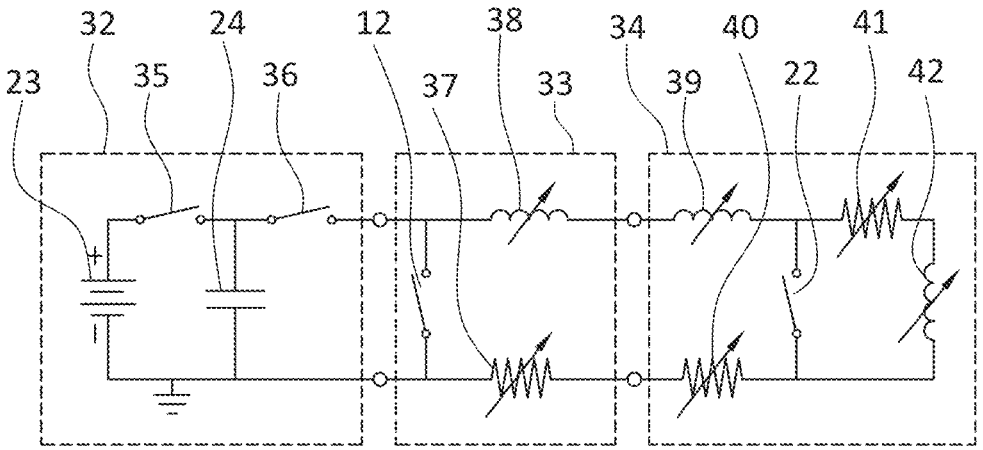
FIG. 3 PRIOR ART
FIG. 3 is a diagram of an electrical circuit that can be provided in the device of FIG. 1.
Figure 4:
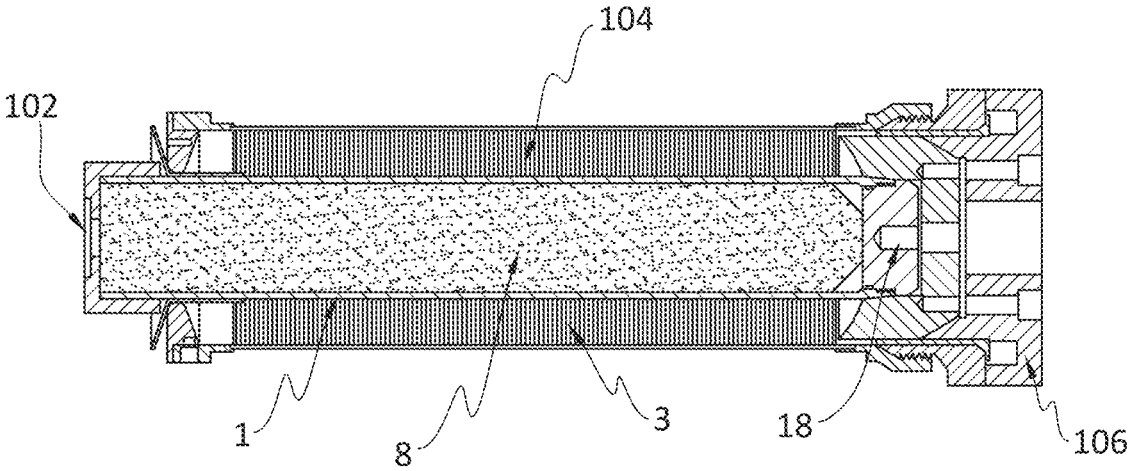
FIG. 4 is a schematic CAD drawing of a helical FCG having a static load on the right-hand side.
Figure 5A:
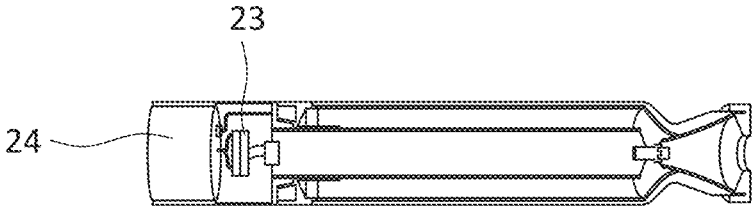
FIGS. 5A 5D show operation of an exemplary FCG device
Figure 5B:
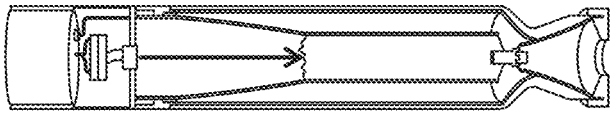
Figure 5C:
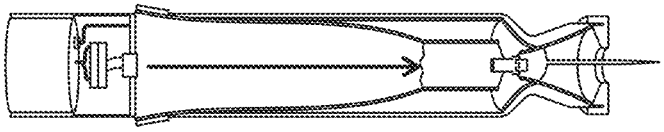
Figure 5D:
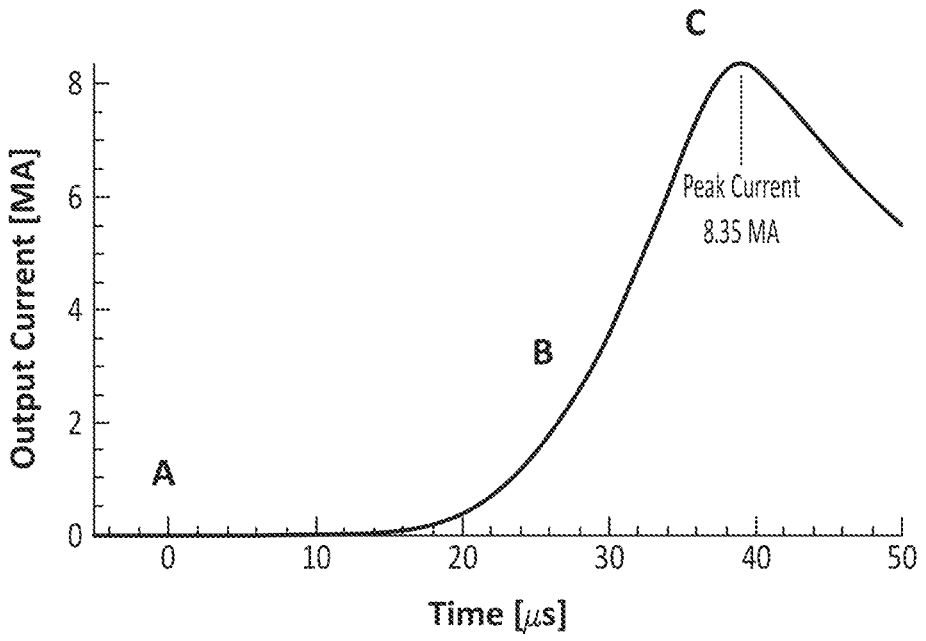

During FCG operation, in effect, the energy released from explosives is transmitted to the electrical load. FIG. 4 shows various parts of a typical helical FCG connected to a static test load 106, which can be replaced by an appropriate dynamic load (fragmentation, shaped charge, HE augmentation, or EM armor) for various applications. An auxiliary electronic system (not shown in the figure) supplies initial seed current to helical coils that constitute stator 3. The seed current creates an initial (seed) magnetic field inside the flux compression zone 104 between armature 1 and stator 3. The armature 1 is typically composed of an aluminum or copper shell and is filled with a HE 8, such as PBXN or Comp-B. When the HE is detonated, the expanding armature closes a "crowbar" (switch) on the initiator side and compresses the trapped magnetic field in the compression zone, thereby multiplying, or amplifying, the magnetic field intensity and associated electrical current. The FCG shown in FIG. 4 also includes an FCG fuse 102. FIG. 4 also shows a glide plane 18. The seed current bank and the permanent magnet are not shown. A load is shown at the right-hand end Operation of an exemplary FCG device (84-mm diameter) with a shaped charge liner is shown at initial (FIG. 5A), middle (FIG. 5B), and near peak (FIG. 5C) current times during a 50 μs FCG pulse time. FIG. 5D shows measured current output from the FCG liner (measured by a Rogowski coil) at initial (A), middle (B) and near peak (C) current times. This FCG device includes a capacitor 23 and a battery 24, the latter being connected between capacitor 24 and a high explosive (8 in FIG. 4).

The measured output current as a function of time from the exemplary FCG device is shown on the right side of FIG. 5. The EM shaped charge liner has replaced the static load of FIG. 4 and it can be noted that the shaped charge jet is formed near the time when the current peaks. While most of the energy goes into the shaped charge jet that is formed by J×B forces, the EM energy from the FCG somewhat heats the copper liner by Joule heating. The length of the entire FCG (~40 cm) and the axial detonation speed of the armature HE (~8 km/s) approximately determine pulse duration (~50 μs in this case). Peak output current and current evolution for a specific inductive and resistive load is determined by flux compression theory and dedicated FCG analytical codes that solve the FCG generator equation.

Enig Associates, Inc. ("ENIG") has already developed an experimentally-validated in-house comprehensive FCG physics prediction code (EX2GEN™), which has been successfully benchmarked against various size FCG experimental results. One can approximately estimate the peak output current expected from an FCG design when seed current, FCG inductance, FCG performance figure of merit α (typically ~0.7–0.9), and load inductance are entered into the following equation:

$$I_{peak} \cong I_{seed}\left(\frac{L_{fcg}}{L_{load}}\right)^{\alpha} \tag{1}$$

Where $L_{fcg}$ and $L_{load}$ are the inductances of the FCG and the load, respectively.

For example, in a previous ENIG program, a record current gain of almost 3800 was achieved by converting 2.2 kA of seed current into 8.5 MA output current when powering a 2 nH static test load. The figure of merit α is the critical parameter to determine the performance of a particular FCG and it depends on the physics of FCG operation. The physics includes resistive loss in helical coils, electrical gas breakdown inside compression zone, and so on. ENIG has been developing the physics based FCG optimization/prediction code including all important physics involved during FCG operation.

Maggen Permanent Magnet Seed-Field Generator

The following explains how the new component of the generator to convert the magnetic field of a permanent magnet to an amplified current according to the invention is enough to serve as a seed current for the main FCG. We have designated this component MAGGEN.

Figure 8:
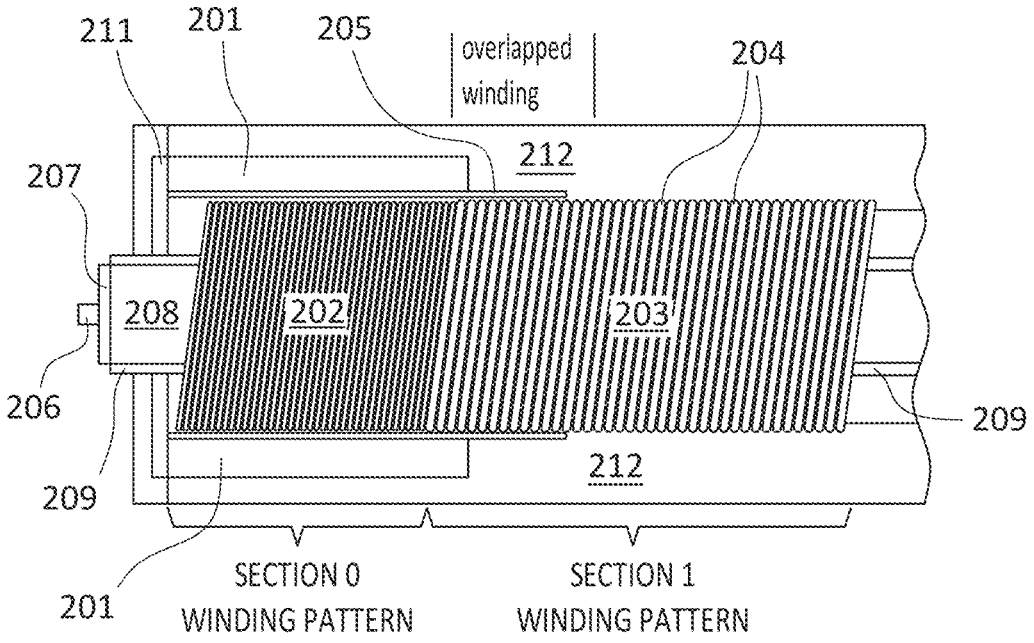
FIG. 8 is a schematic drawing of a permanent magnet seed-field generator (MAGGEN) coil winding pattern.

MAGGEN works to generate a required seed current and magnetic flux underneath the initial helical stator section (SECTION 1 as shown in FIG. 8) of the main FCG. The desired effective main seed current for the main FCG depends on the size and the design of the main FCG, so we will use the general formalism to design the MAGGEN system. Typical main seed currents used by previous ENIG-designed FCGs were between 1-10 kA with the associated seed magnetic flux.

Figure 6:
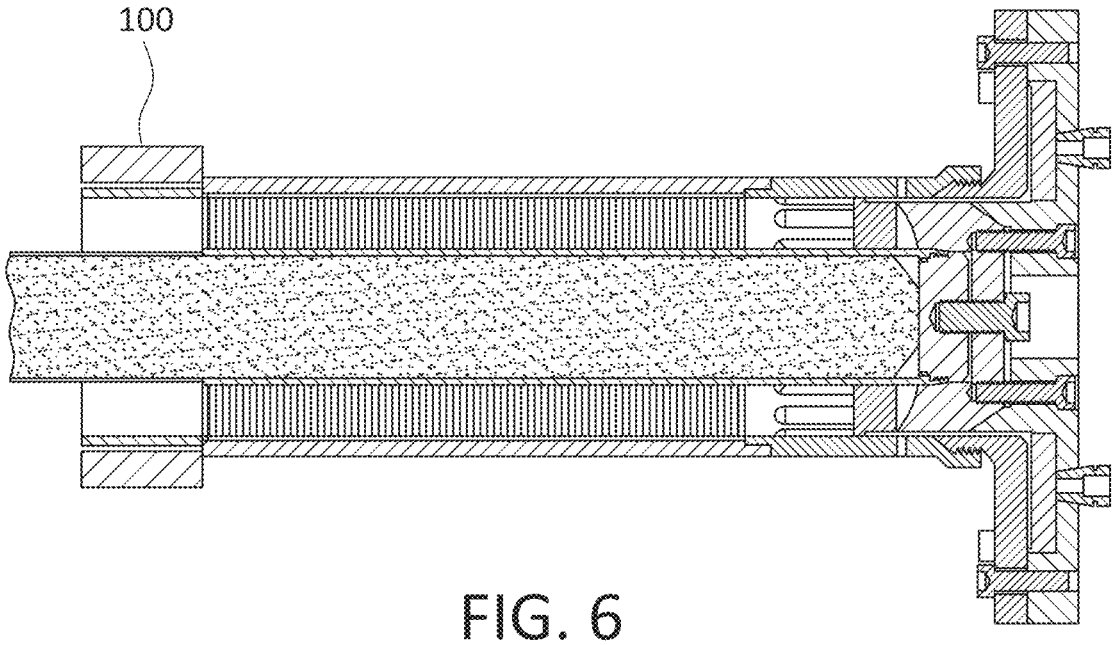
FIG. 6 shows an FCG with a PM (permanent magnet) 1 seed current system and a static load.

FIG. 6 shows a complete FCG system that includes a MAGGEN on the left, a unified generator (helical and coaxial FCG) in the middle, and a static inductive load on the right. The unified HE-filled armature serves as a flux compression armature for both MAGGEN and FCG. There is only one detonator (e.g., RP-80) required to initiate flux compression to MAGGEN and then FCG. There is no initial current in any part of the whole device until the expanding armature starts to compress magnetic flux inside the cylindrical shell shaped magnet. Cylindrical permanent magnet 100 is shown on the left-hand side of the figure. There is only one detonator for the whole operation and the system starts with no current. The cylindrical shell shaped Neodymium magnet 100 is shown at the left-hand end of the figure and a load is shown at the right-hand end.

Figure 7:
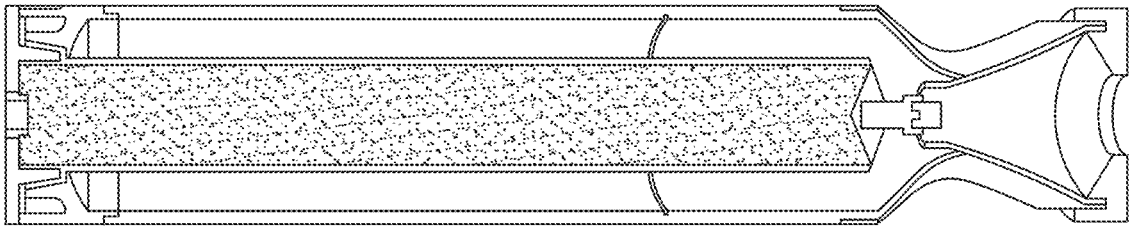
FIG. 7 is a pictorial view of an integrated PM seed+FCG+Static load.

FIG. 7 depicts a photorealistic pictorial drawing of an integrated PM, FCG and static load. FIG. 7 shows a single detonator, a uniform armature for the PM section and the FCG section. A cylindrical PM is not shown in this drawing. There is no electrical current supply to the device.

Figure 9:
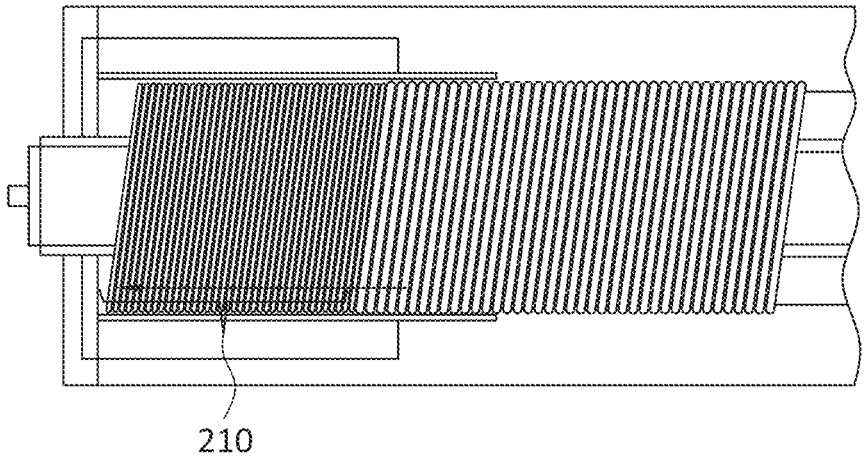
FIG. 9 is a schematic drawing of a further exemplary MAGGEN embodiment.

More details of MAGGENs can be seen in FIGS. 8 and 9, showing different embodiments of how the coil is wound inside the MAGGEN. Embodiment #1, (FIG. 8) uses a single layer of helical coil 202 in Section 0, underneath the magnet 201 and the multi-turn coil is directly connected to the couple of tail load loops 204 (shown as loops embedded in the Section 1 of the FCG in FIG. 8).

Embodiment #2 (FIG. 9) uses a double layer of helical coils underneath the magnet and the tail load loops are connected to both layers of the helical coils. Outer layer coils 210 in FIG. 9 replace the return wire 205 in FIG. 8. All other components are the same in both FIGS. 8 and 9. Thus, double layer of helical coils in FIG. 9 is composed of the single layer of coils 202, better shown in FIG. 8, and the outer layer coils 210.

In FIG. 8, the generator and coil winding patterns include both a main generator coil section (two layered helical coil sections) and dual tail loop coils. These tail loop coils 204, shown in the "overlapped winding" portion at the left-hand end of SECTION 1 into which a portion of the coil from SECTION 0 extends. The coil in SECTION 1 is the main FCG coil section. The tail loop coils 204 act as a low inductance load to amplify the current in the MAGGEN and associated compressed magnetic flux underneath during explosive expansion of the armature. PM 201 and return wire 205 are also shown in the figure.

These dual tail loops (204 in FIG. 8) serve as a flux compression load of MAGGEN and detailed geometry (number of loops, spacing between loops, location of loops, etc.) can be determined by a parametric study to maximize the seed magnetic field for the main FCG.

The MAGGEN main helical SECTION 0 in FIG. 8 has densely packed helical coils 202 underneath the magnet 201, and this SECTION 0 must have much higher inductance than the load tail loops 204. The two tail loops 204 are directly adjacent helical coils 202. After winding the two load tail loops 204, a return wire 205 in FIG. 8 can come back straight and be electrically connected to the start of the left side of the main MAGGEN helical coils 202 (FIG. 8 SECTION 0). The return wire 205 may be replaced by helical coils to form an additional helix 210 in FIG. 9 (with the same winding direction as the first layer helix 202), to increase the inductance of the MAGGEN main coil. The main requirement for the main helical coil designs is that the expanding armature must electrically short circuit the main helical coil underneath the magnet during MAGGEN operation.

Referring to FIG. 8, MAGGEN operation starts with a single initiation of detonator 206. A booster 207 spreads a detonation wave form to a linear front and a high explosive 208 expands a metal armature 209 in the radial direction. During detonation, armature 209 takes on a conical shape from the detonation side and the conical shape sweeps through the whole armature from the left side as shown in FIG. 5. The cylindrical shell metal armature 209 extends all the way from the booster 207 throughout the whole device including the FCG, where only part of the FCG (i.e., section 1) is shown in FIGS. 8 and 9. There is a preexisting magnetic field inside permanent magnet ring 201. This magnetic field between magnet ring 201 and armature 209 is compressed when armature 209 radially expands away from the exploding HE after detonation. When the magnetic flux is being compressed, the current inside helical coil section 202 increases from zero. During this magnetic flux compression process, the inductance of the MAGGEN coil 202 decreases to amplify the MAGGEN current in dual tail loop coil 4 according to Eq. (1).

The initial seed current in Eq. (1) should be interpreted as an equivalent seed current with a corresponding seed magnetic field permanently supplied by permanent magnetic ring 201. A nonconducting spacer disk 211 is shown in FIG. 8 to illustrate that central armature 209 is not structurally floating in the middle. The permanent magnet and all helical coils are, mechanically and structurally held in place by an embedded epoxy compound 212. The structural components 211 and 212 are not important for the electromagnetic operation of MAGGEN and FCG during explosion.

The equivalent circuit diagram (FIG. 10) can be used to explain the physics of the current amplification from zero to an amplified seed current for the main FCG. This figure schematically represents the MAGGEN and FCG in both Embodiment #1 (FIG. 8) and Embodiment #2 (FIG. 9).

Initially, prior to detonation initiation, there is no current anywhere in the whole device including MAGGEN. There, however, is a preexisting magnetic field inside the permanent magnet (201 in FIG. 8). In FIG. 8, the MAGGEN main helical coil 202, two tail loops 204, and the return wire 205 will form the MAGGEN electrical circuit connected in series to form a closed circuit.

Figure 10:
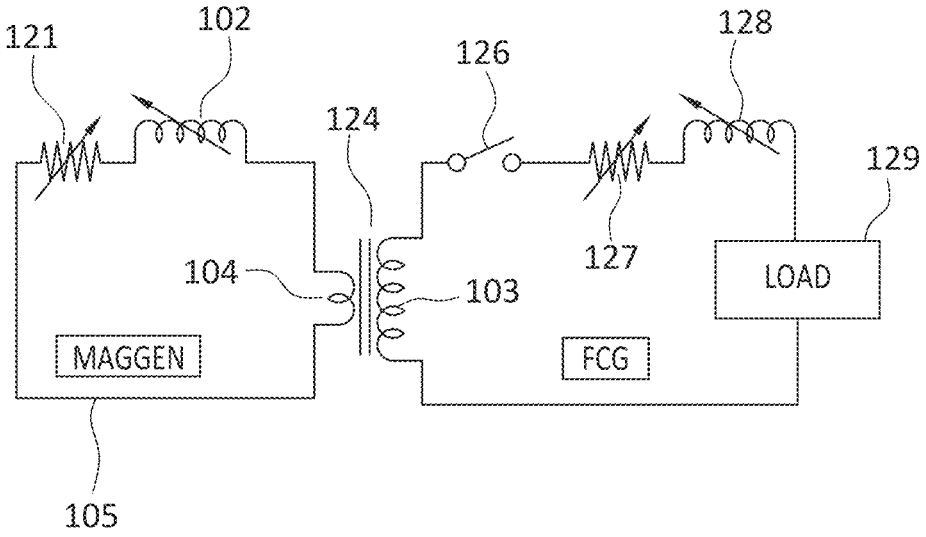
FIG. 10 is a schematic drawing of an equivalent circuit diagram representing MAGGEN and FCG together.

This is shown in equivalent circuit diagram FIG. 10 as the MAGGEN part. In FIG. 10, the inductance 102 represents the main helical coil 202, the inductance 104 represents the tail loop coils 204, and these two coils are connected by return wire 105 to form a closed electrical series circuit of MAGGEN. The internal resistance of the circuit is shown as dynamic resistance 121 in FIG. 10. After explosive detonation, the expanding left-hand side of the armature 209 contacts the main helical coil 202 and return wire 205 and the armature contact point moves to the right as the detonation wave moves to the right. The length of the return wire 205 is shortened to maintain electrical contact with helical coil 202. During this process, the inductance of main coil 202 and internal resistance monotonically decrease, as shown as dynamic inductance and resistance in the MAGGEN part of FIG. 10. In FIG. 10, there is no initial current in the MAGGEN part of the circuit, but there is an initial preexisting magnetic flux inside permanent magnet 201. During armature expansion, magnetic flux is compressed between PM 201 and armature 209 and the current in dynamic main coil 202 and the tail loops 204 will increase monotonically from zero to an amplified value. This process will create the seed magnetic field inside the tail load loops 204 and the open-circuited FCG.

As shown as a closing switch 126 in FIG. 10, SECTION 1, the left-hand end of coil 203 of FCG SECTION 1 is not electrically connected until an armature contact points passes through SECTION 1 during detonation. That is to say, the left-hand end of coil 203 is electrically isolated, or disconnected, until the armature contact point touches the left-hand end of the coil. The amplified magnetic flux formed during MAGGEN operation becomes the seed magnetic flux for the main FCG. This is shown as a transformer coupling 124 in FIG. 10. As the armature contacts the initial open coil (left-hand end of coil 203), FCG electrical circuit is closed and the amplified magnetic flux is now trapped in FCG coil 203 and this amplified magnetic flux will serve as the seed magnetic flux for the main FCG. So coil 203 of SECTION 1 in FIG. 8 is represented by the secondary coil 103 in FIG. 10, and the transformer coupling 124 in FIG. 10 represents magnetic flux transfer from MAGGEN to FCG, and the closing switch 126 represents the electrical contact of expanding armature 209 with the left-hand part of FCG coil 203. After this process, the rest of the operation is the same as the conventional FCG operation and MAGGEN operation is over. FCG dynamic inductance, the resistance, and the load are represented as 127, 128, and 129, respectively. The main reason why the closing switch 126 is required for FCG is to facilitate magnetic flux transfer from MAGGEN to FCG seed coil 103. If the FCG circuit is closed during MAGGEN operation, the amplified magnetic flux from MAGGEN must penetrate through FCG seed coil 203 by magnetic flux penetration through the coil. This will take magnetic flux diffusion time penetrating through metal coil and this time scale is not significantly shorter than explosion operation time scale of MAGGEN. After MAGGEN operation, the duty of MAGGEN to generate enough seed magnetic flux for FCG is now over.

FIG. 9 shows a schematic drawing of the Embodiment 2 that has dual layer helical winding in the main MAGGEN section. The MAGGEN operation and FCG coupling connection are almost identical to the embodiment of FIG. 8, except that the SECTION 0 has dual layer helical coils with return wire 205 in FIG. 8 being replaced by a return outer layer of helical coils 210 in FIG. 9 and the end point of the return helical coil is electrically connected to the beginning point of the inner layer helical coils 202. In embodiment 2 (FIG. 9), the electrical circuit of MAGGEN is closed as in embodiment 1. The advantage of the embodiment 2 over embodiment 1 is that the MAGGEN main inductance increases by the square of the total number of coil windings in section 0 in both embodiments, so that approximately a factor of 4 enhancement in FCG seed current can be achieved for the same volume of the MAGGEN device. In this case, the return wire 205 in FIG. 8 is replaced with additional helical winding coils 210 (outer layer of the original helical winding 202), to increase the inductance of the main coil. The additional helical winding coils 210 wrap around the SECTION 0 helical coils 202 in FIG. 8, replacing the return wire 205 in FIG. 8. Coil inductance increases as the square of the number of turns, so the increase in inductance is significant.

There can be many different variations of the MAGGEN designs, but the main concept is to use a permanent magnet to supply a seed magnetic field of MAGGEN. The magnetic field of the permanent magnet is always on, but there is no current in the whole system until the armature starts to expand. Armature expansion compresses magnetic flux between the stator (MAGGEN helical coils) and the armature, to increase the magnetic flux from the initial value while conserving magnetic flux in the flux compression zone of the system. The associated current starts from zero to a finite value that is determined by flux conservation law. To achieve this objective, load inductance must be much less than the main inductance of the MAGGEN and internal resistance of all coils should be minimal to maximize output.

Although there is no initial seed current to start within both MAGGEN operation and main FCG operation, we can approximately calculate the "effective" seed current that is equivalent to the seed magnetic flux for Eq. (1).

Figure 11:
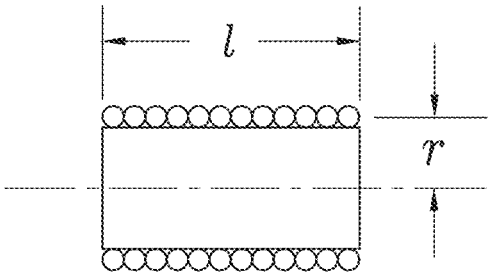
FIG. 11 provides a simplified pictorial view illustrating a wire coil used in the practice of the present invention, together with an associated equation.

The formula and illustration in FIG. 11 can be used to estimate the main coil inductance of the MAGGEN. According to Wheeler [Wheeler, H., A.: "Inductance formulas for circular and square coils"; Proceedings of the IEEE, Vol. 70, Issue 12, pp. 1449-1450, 1982], this formula applies when 1>0.8r.

For example, if we have L=4" (~10 cm), D=4", 1 mm wire diameter, d, N=100 turns, we get:

$L$=690μ$H$ for embodiment #1, and 2759μ$H$ for embodiment #2 with 200 turns.

For the inductance of the tail load wire loop, we use the formula below with a caveat. One can calculate more accurate inductance of multiple sparsely separated loops with the EM code, but we will use the simpler version here.

$$L_{loop} \approx N^2 \mu_o \mu_r \left(\frac{D}{2}\right) \cdot \left(\ln\left(\frac{8 \cdot D}{d}\right) - 2\right)$$

where $\mu_o$ is vacuum magnetic permeability, $\mu_r$ is relative permeability, and N is the number of turns.
For 1 loop, with a 4" D and 1 mm d, this gives $L_{oneloop}$=0.3μ$H$ For densely packed two loops, L=$2^2$×0.3 μH and for far-separated two loops, L=2×0.3 μH. We will choose 0.9 μH for loosely separated two loops as shown in FIGS. 6 and 7. Actual inductance of main and tail coils in MAGGEN should subtract the contribution from the armature area for dynamic inductance. At this point, however, we are only interested in the ratio of these two inductances in Eq. (1) to calculate the current gain. For the above example case, for MAGGEN we get $L_{main}/L_{load}$=2300 for $D$ #1, and 9197 for $D$ #2.

For the effective resistive loss, we approximate that effect with a "figure of merit" α, that typically ranges from 0.7 (poorly designed generator) to 0.9 (good generator). As an example, we will choose 0.8. The current gain factor in Eq. (1) then becomes, $(L_{main}/L_{load})^{\alpha}$=489 and 1482, respectively.

Now, we have to estimate the "effective" seed current from a neodymium magnet seed field and multiply with the current gain factor above to calculate the peak current in MAGGEN. After that, we have to calculate the peak averaged magnetic field under the tail load loops first section of the main FCG. By comparing this magnetic field with the magnetic field produced by the conventional capacitor bank driven seed current field, we can conclude how much effective seed current can be applied from MAGGEN.

The B-field inside the cylindrical neodymium magnet is typically highly-localized near the magnet. The remnant magnetic field of neodymium can reach up to 1.4 T, but for our application we will just use an estimated 0.3 Tesla as the average B-field inside PM between the armature and stator. This number is approximately validated by the multi-physics COMSOL code. To generate 0.3 T B-field from main coil currents in FIG. 6, we would need about 238 A current in the coil from the simple formula of B=μnI, where n is the number of turns per m and μ is magnetic permeability. Now, from Eq. (1), our load current in two tail loops at the end of MAGGEN operation will be 117 kA. This is not the seed current to the main FCG. This will generate seed magnetic field under the main FCG. That magnetic field can be approximately calculated for Helmholtz coils. This formula applies at the center of the coils when coils are separated by loop radius. In our case n=1.

$$B = \left(\frac{4}{5}\right)^{3/2} \frac{\mu_0 n I}{R},$$

The Helmholtz load current, 117 kA, from MAGGEN will generate seed magnetic field of 2 T under the first section of the main FCG. Assuming that the first section of the main FCG is a densely packed single helical coil section, then this is equivalent to seeding capacitor-bank driven currents as in the table below (using B=μnI).

| | 18AWG | 16AWG | 14AWG | 12AWG |
|---|---|---|---|---|
| Diameter | 1.22 mm | 1.63 mm | 2.03 mm | 2.64 mm |
| Effective seed current | 2.04 kA | 2.84 kA | 3.52 kA | 4.59 kA |

If we repeat the same calculation for the Embodiment #2, we get better results.

| | 18AWG | 16AWG | 14AWG | 12AWG |
|---|---|---|---|---|
| Effective seed current | 6.12 kA | 8.52 kA | 10.56 kA | 13.77 kA |

Therefore, it seems feasible that MAGGEN can generate enough seed current (2 kA-13 kA from the neodymium permanent magnet in our example for a 4" D device) for the main FCG to generate 10's of MA for real application. Clearly this mechanism is scalable to a larger size device so that the effective seed current is not limited by the above numbers.

What is claimed is:

1. An explosive device comprising: an auxiliary flux compression generator operating to produce a high intensity magnetic field to seed a primary flux compression generator, said auxiliary flux compression generator having a first section with a magnetic field supplied by a cylindrical permanent magnet array, said first section comprising a helical winding having a prescribed pattern configured to convert explosive energy into magnetic energy that will be used as the seed magnetic field for the primary flux compression generator.

2. The device, according to claim 1, wherein said first section comprises two inductive coils connected to amplify a current from zero to a finite value by a flux compression mechanism.

3. The device according to claim 2, wherein said amplified magnetic flux and current underneath the load coil of the auxiliary generator and the initial section of the primary generator serves as the seed magnetic field for the primary generator to increase the peak magnetic flux and current to a maximum value.

4. The device according to claim 1, wherein auxiliary generator comprises a stator assembly having a first stator member composed of a helical coil of electrically conductive material and a second stator member composed of a helical coil of electrically conductive material, said first and second stator members being electrically disconnected from one another but coupled inductively, as in conventional transformer coupling between primary and secondary coils, to one another in series by common magnetic flux.

5. The device according to claim 4, wherein said auxiliary generator further comprises an armature constituted by a unitary body that is axially coextensive with said first and second stator members.

6. The device according to claim 5, wherein said first and second stator members operate sequentially by a single initiation detonator.

* * * * *